US008669715B2

(12) United States Patent
Riesebosch

(10) Patent No.: US 8,669,715 B2
(45) Date of Patent: Mar. 11, 2014

(54) LED DRIVER HAVING CONSTANT INPUT CURRENT

(75) Inventor: Scott Riesebosch, St. Catherines (CA)

(73) Assignee: CRS Electronics, Ontario (CA)

( * ) Notice: Subject to any disclaimer, the term of this patent is extended or adjusted under 35 U.S.C. 154(b) by 185 days.

(21) Appl. No.: 13/092,430

(22) Filed: Apr. 22, 2011

(65) Prior Publication Data

US 2012/0268030 A1 Oct. 25, 2012

(51) Int. Cl.
*H05B 41/16* (2006.01)
*H05B 41/24* (2006.01)

(52) U.S. Cl.
USPC ..... 315/276; 315/185 R; 315/254; 315/291; 315/302

(58) Field of Classification Search
None
See application file for complete search history.

(56) References Cited

U.S. PATENT DOCUMENTS

| | | | | |
|---|---|---|---|---|
| 4,047,049 | A | 9/1977 | Erickson et al. | |
| 5,297,013 | A | 3/1994 | Hall et al. | |
| 5,977,692 | A | 11/1999 | Itaya et al. | |
| 6,577,512 | B2 * | 6/2003 | Tripathi et al. | 363/21.17 |
| 6,836,157 | B2 | 12/2004 | Rader et al. | |
| 7,091,874 | B2 | 8/2006 | Smithson | |
| 7,196,481 | B2 | 3/2007 | Bushell et al. | |
| 7,206,015 | B2 | 4/2007 | Tang et al. | |
| 7,269,191 | B2 | 9/2007 | Stewart et al. | |
| 7,276,861 | B1 | 10/2007 | Shteynberg et al. | |
| 7,286,123 | B2 | 10/2007 | Yang | |
| 7,295,176 | B2 | 11/2007 | Yang | |
| 7,414,370 | B2 | 8/2008 | Kunjappan | |
| 7,492,108 | B2 | 2/2009 | Garcia et al. | |
| 7,609,008 | B1 | 10/2009 | Kohler | |
| 7,626,346 | B2 | 12/2009 | Scilla | |
| 7,635,957 | B2 | 12/2009 | Tripathi et al. | |
| 7,656,366 | B2 | 2/2010 | Ashdown | |
| 7,663,326 | B2 | 2/2010 | Santo et al. | |
| 7,675,250 | B2 | 3/2010 | Chitta et al. | |
| 7,701,151 | B2 | 4/2010 | Petrucci et al. | |
| 7,733,034 | B2 | 6/2010 | Kotikalapoodi et al. | |
| 7,755,303 | B2 | 7/2010 | Johnson et al. | |
| 7,768,212 | B2 | 8/2010 | Chen et al. | |
| 7,777,424 | B2 | 8/2010 | Hebborn | |
| 7,777,430 | B2 | 8/2010 | Catalano et al. | |
| 7,786,676 | B2 | 8/2010 | Cheng et al. | |
| 7,825,610 | B2 | 11/2010 | Zhao et al. | |
| 2004/0032221 | A1 | 2/2004 | Bushell et al. | |
| 2006/0186830 | A1 | 8/2006 | Shami et al. | |
| 2007/0035538 | A1 | 2/2007 | Garcia et al. | |
| 2007/0195527 | A1 | 8/2007 | Russell | |
| 2007/0279900 | A1 | 12/2007 | Bauer et al. | |
| 2007/0295912 | A1 | 12/2007 | Jurgen et al. | |
| 2008/0018261 | A1 | 1/2008 | Kastner | |
| 2008/0037239 | A1 | 2/2008 | Thomas et al. | |
| 2008/0111505 | A1 | 5/2008 | Wang et al. | |
| 2008/0224625 | A1 | 9/2008 | Greenfeld | |

(Continued)

FOREIGN PATENT DOCUMENTS

| | | |
|---|---|---|
| KR | 100779971 | 11/2007 |
| KR | 20070074077 | 12/2007 |

(Continued)

*Primary Examiner* — Anh Tran
(74) *Attorney, Agent, or Firm* — Bingham McCutchen LLP

(57) ABSTRACT

Power consumed by an LED driver may be reduced by drawing, from an electronic transformer or dimmer, an input current that is constant over a plurality of input voltages. Power derived from the constant input current is provided to the LED driver.

14 Claims, 2 Drawing Sheets

(56) References Cited

U.S. PATENT DOCUMENTS

| | | | | |
|---|---|---|---|---|
| 2009/0033245 | A1 | 2/2009 | Tsai et al. | |
| 2009/0033248 | A1 | 2/2009 | Cottongim et al. | |
| 2009/0146585 | A1 | 6/2009 | Huang et al. | |
| 2009/0167202 | A1 | 7/2009 | Miskin et al. | |
| 2009/0256486 | A1 | 10/2009 | Lai | |
| 2009/0261748 | A1 | 10/2009 | McKinney et al. | |
| 2009/0273301 | A1 | 11/2009 | De Anna et al. | |
| 2009/0289559 | A1 | 11/2009 | Tanaka et al. | |
| 2009/0295292 | A1 | 12/2009 | Harmgardt et al. | |
| 2009/0302770 | A1 | 12/2009 | Weis et al. | |
| 2010/0013395 | A1 | 1/2010 | Archibald et al. | |
| 2010/0013409 | A1 | 1/2010 | Quek et al. | |
| 2010/0045210 | A1 | 2/2010 | Hariharan | |
| 2010/0084994 | A1 | 4/2010 | Kao | |
| 2010/0097002 | A1* | 4/2010 | Shatford et al. | 315/210 |
| 2010/0134049 | A1 | 6/2010 | Matsuoka et al. | |
| 2010/0156315 | A1 | 6/2010 | Zhao et al. | |
| 2010/0164404 | A1 | 7/2010 | Shao et al. | |
| 2010/0194308 | A1 | 8/2010 | Zhao et al. | |
| 2010/0231136 | A1 | 9/2010 | Reisenauer et al. | |
| 2010/0295617 | A1 | 11/2010 | Muentefering et al. | |
| 2011/0121744 | A1* | 5/2011 | Salvestrini et al. | 315/246 |
| 2011/0121760 | A1* | 5/2011 | Harrison et al. | 315/309 |

FOREIGN PATENT DOCUMENTS

| | | |
|---|---|---|
| TW | 1282713 | 7/1994 |
| WO | WO9400965 | 1/1994 |
| WO | WO2007100207 | 9/2007 |
| WO | WO2009022153 | 2/2009 |
| WO | WO2010027254 | 3/2010 |
| WO | WO2010090832 | 8/2010 |

* cited by examiner

LED DRIVER HAVING CONSTANT INPUT CURRENT

TECHNICAL FIELD

Embodiments of the invention generally relate to power consumption in LED drivers and, more particularly, to reducing power consumption thereof.

BACKGROUND

Two basic types of low-voltage transformers are typically used in lighting systems: magnetic transformers and electronic transformers. Magnetic transformers tend to be large, expensive, and heavy, so their electronic alternatives are often used instead. Electronic transformers receive a standard 60 Hz AC mains (or similar) voltage and, using an oscillator circuit that drives a solid-state transformer circuit, step down the input AC input voltage to a lower-voltage, high-frequency (usually above 20 kHz) AC output. The electronic transformer may be tapped such that an auxiliary winding of the transformer picks up magnetic flux generated by the output current to the transformer's load. This self-feedback is used to keep the transformer oscillating. If the output current is not high enough, however, the oscillation may become unstable or stop completely.

Currently, light-emitting diode ("LED") replacement lamps use off-the-shelf LED-driver integrated circuits ("ICs") designed to drive the one or more LEDs in the lamp at a constant current. As the input voltage falls, therefore, the IC automatically pulls more input current from the input supply to try to maintain a constant output power and current delivered to the LEDs. Conversely, when the input voltage rises, the LED driver pulls less input current from the input supply, which again stabilizes the current and power delivered to the LEDs. Some LED drivers include an input-current limiting circuit to protect input components if an undervoltage condition occurs on the input; an LED driver without such a limiting circuit might attempt to draw a damaging amount of input current to compensate for the low input voltage. Other LED drivers may use an undervoltage-lockout ("UVLO") circuit to achieve the same protection.

While this circuit configuration may work for some lighting applications, it may cause problems in combination with electronic low-voltage transformers of the type commonly used in LED lighting systems. The feedback mechanism in the electronic transformer responsible for keeping the transformer oscillating is driven only by the current drawn from the transformer. As the voltage waveform output by the transformer and applied to the LED driver rises, a prior-art LED driver pulls less current. This reduction in current drawn from the electronic transformer may cause it to shut down if the current draw falls below what is required (i.e., the hold current of the transformer). On the other hand, if the input voltage drops too low, the LED driver pulls higher current, thereby unnecessarily increasing the power delivered to the LED lamp. Because the LED lamp can dissipate only a limited amount of power, this increase in power delivered may result in an over-temperature condition in the LED lamp. A need therefore exists for a way to prevent an LED driver from drawing both too little or too much current from an electronic transformer.

SUMMARY

In general, various aspects of the systems and methods described herein relate to an LED driver that draws constant input current from an electronic transformer (and/or a dimmer, if one is included in the lighting system). The constant input current is greater than the hold current of either or both of the electronic transformer and dimmer, so that, over a wide range of input voltages, the electronic transformer and dimmer operate normally. Because neither component suffers a low-hold-current condition, transmission of power to the LED is uninterrupted and light provided by the LED does not flicker or otherwise falter.

In one aspect, a method reduces power consumed by an LED driver. An input current (that is substantially constant over a plurality of input voltages) is drawn from an electronic transformer or dimmer. The input current is provided to power the LED driver.

In various embodiments, the constant input current is greater than or substantially equal to a minimum hold current of one of the dimmer or the electronic transformer (and/or the greater of the two). A value of the constant input current may be determined or previously determined. Determining the value of the constant input current may include adjusting the input current until a hold current of one of the electronic transformer or the dimmer is reached. The reaching of the hold current may be determined by a collapse of an input power waveform. An output current of the LED driver may be monitored, and the constant input current may be lowered when the output current exceeds a threshold.

In another aspect, a system reduces power consumed by an LED driver. A constant-current sink draws (from an electronic transformer or dimmer) an input current that is constant over a plurality of input voltages. An output driver receives the constant input current and powers an LED therewith.

In various embodiments, a hold-current analyzer determines a hold current of one of the electronic transformer or dimmer; the constant input current may be greater than or substantially equal to the hold current. The hold-current analyzer may include digital processing logic and a storage element and/or an input current controller for lowering the input current until a collapse of an input power waveform is detected. A storage element may store a predetermined value of the constant input current. A current sensor may determine a level of an output current provided to the LED. The output driver may reduce the output current if the current sensor detects the output current increasing past a threshold. The constant-current sink may include a current source or a switched-capacitor circuit and may reduce the constant input current if the current sensor detects the output current increasing past a threshold.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. In the following description, various embodiments of the present invention are described with reference to the following drawings, in which.

DETAILED DESCRIPTION

Described herein are various embodiments of methods and systems for an LED driver circuit that draws a substantially constant input current from an AC source or dimmer over a wide input voltage range. By "substantially" is meant within the practical tolerance of the component(s) being controlled, e.g., within 10% or, in some embodiments, within 5%. For example, "a substantially constant input current" can refer to a current with sufficiently small variability that the driven LED is not powered beyond a safe operating range (e.g., to an over-temperature condition) while upstream components do not experience current reductions that cause them to malfunction.

Figure 1:
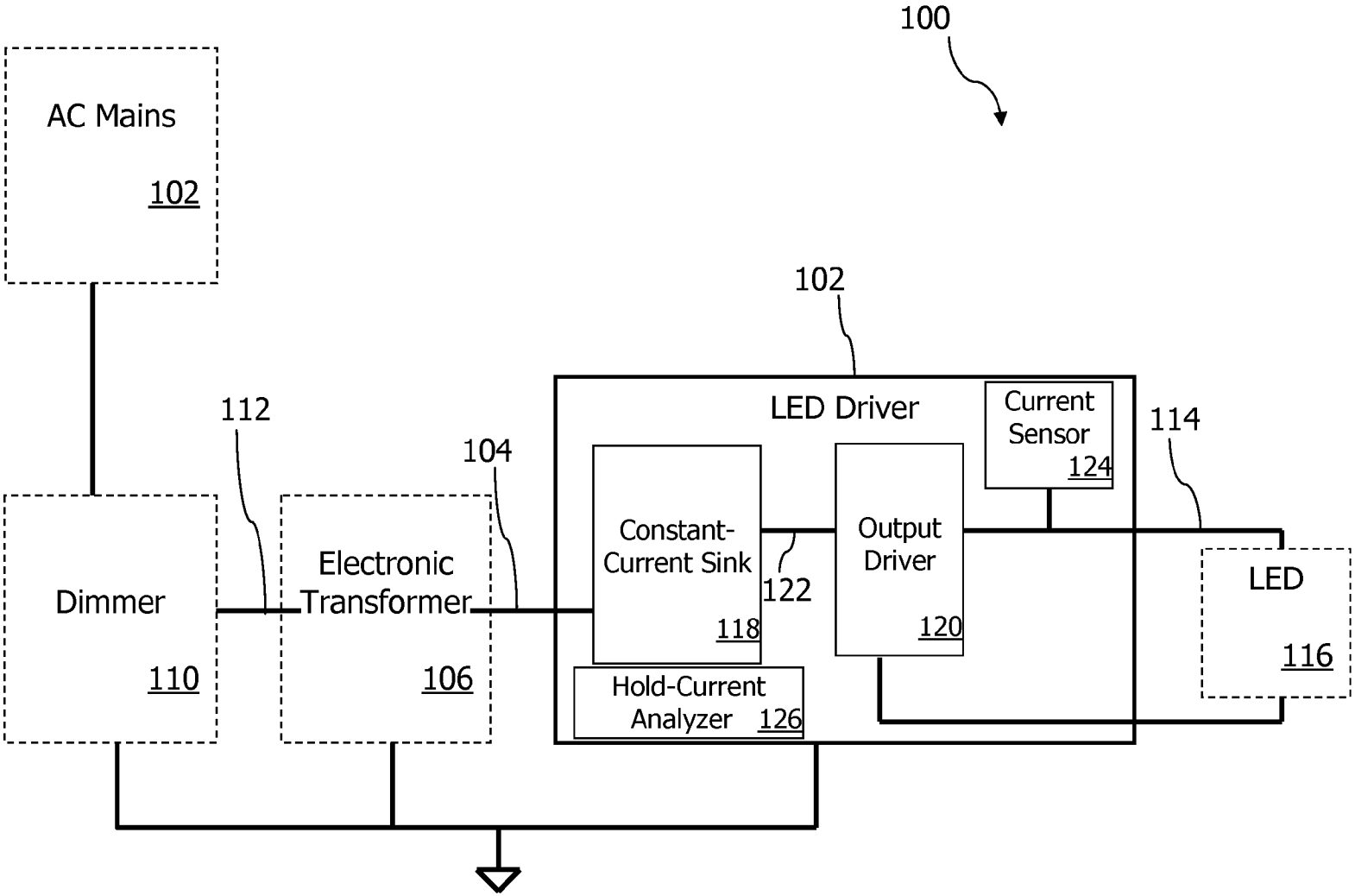
FIG. 1 is a block diagram illustrating an LED driver circuit for drawing a constant input current in accordance with an embodiment of the invention.

An embodiment of such a circuit is illustrated in FIG. 1. An LED driver 102 is disposed in an LED lighting system 100. The LED driver 102 receives an input supply signal 104 from an electronic transformer 106, which may be incorporated into a larger power supply unit and may be powered by an AC mains voltage 108. A dimmer circuit 110 may intercept the input supply signal 104 at an upstream point 110 and may modify the input power supply signal 104 in accordance with a user control. The dimmer 110 may be configured as a leading-edge dimmer, trailing-edge dimmer, and may be a mains dimmer, triac-based dimmer, or any other dimmer circuit known in the art. The LED driver 102 produces an output signal 114 having a current within a range for safely driving an LED 116. The LED 116 may include one or more LEDs arranged in one or more strings and may further include current sensors, series resistors, and/or any other types of support circuitry known in the art. The present invention is not limited, however, to any particular implementation of the electronic transformer 106, dimmer 110, or LED 116.

The LED driver 102 includes a constant-current sink 118 that draws a constant current from the electronic transformer 106 and/or dimmer 110. In one embodiment, the drawn current is at or near the higher of the hold current of the electronic transformer 106 and the hold current of the dimmer 110. The drawn current is substantially constant (e.g., within 5% of a nominal value) over a wide input voltage range (e.g., between approximately 5 and 50 volts AC). The constant-current sink may be a conventional current source that draws a constant current from the input signal 104, a switched-capacitor circuit that selectively engages or disengages to draw a constant input current, or any other implementation of a current sink as known in the art.

The constant-current sink 118 provides power to an output driver circuit 120. The output driver circuit 120 may receive a current- or voltage-mode signal 122 from the constant-current sink 118 and provide the output signal 114 to the LED 116. In various embodiments, the output driver 120 is a typical LED output driver; it provides a current output that is within a tolerance range of the LED 116, and may include regulation circuitry, over-voltage and/or over-current protection circuitry, circuitry to monitor the status of the LED 116, circuitry to adjust the level of the output current 114 in response to the status of the LED 116, and/or any other circuitry known to those of skill in the art and appropriate to a particular application. The output driver 120 may be housed in the same package as the constant-current sink 118 or even on the same die as the constant-current sink 118; in other embodiments, the output driver 120 is a discrete component in the system 100, and it communicates with the constant-current sink 118 via circuit interconnect (e.g., printed-circuit board traces). In these embodiments, the output driver 120 may be a standard, off-the-shelf component.

The LED driver 102 may include a current sensor 124 to sense the output current 114. In one embodiment, the current sensor detects if and when the output current 114 increases past a threshold level that may be damaging to the LED 116. In various embodiments, this threshold level may be 0.5, 1, or 2 amps. If the threshold level is reached, the current sensor 124 may send a signal to the constant-current sink 118 and/or the output driver 120 to reduce the output current 124. In one embodiment, in response to the signal from the current sensor 124, the constant-current sink 118 reduces the amount of current it draws from the input signal 104. The reduction may lower the drawn current to the level of the greater of the hold currents of the electronic transformer 106 and the dimmer 110. In an extreme case (if, e.g., the output current 114 is at a level that might cause immediate damage to the LED 116), the constant-current sink 118 may reduce the amount of drawn current below the hold-current level of the electronic transformer 106 and/or dimmer 110. In other embodiments, the output driver 120 lowers the output current instead of or in addition to the adjustments made by the constant-current sink 118.

A hold-current analyzer 126 may be used to detect the minimum amount of input current drawn over the input signal 104 that satisfies the hold-current requirements of both the electronic transformer 106 and the dimmer 110. The hold-current analyzer 126 may be a microcontroller, application-specific integrated circuit, or other type of digital processing logic, and may include volatile or nonvolatile storage elements. In one implementation, the hold-current analyzer 126 sends a signal to the constant-current sink 118 that adjusts the amount of drawn input current. As the hold-current analyzer 126 directs the lowering of the input current, it monitors the input signal 104 and/or a derivative signal in the current sink 118 for signs that the input current has fallen below the hold-current requirements of the electronic transformer 106 and/or dimmer 110. For example, the hold-current analyzer 126 may detect the collapse of the power-delivery envelope delivered by the electronic transformer 106 as it ceases oscillating due to a too-low output current (i.e., the input power waveform dropping suddenly to zero) or may detect the shutting off of the dimmer 110. The hold-current analyzer 126 may determine that the value of the input current producing this collapse is too low and increase the input current accordingly (to e.g., a last known good value). Once the minimum hold current has been detected, the hold-current analyzer 126 stores the detected value in non-volatile memory, and directs the current sink 118 to operate at the stored level. In other embodiments, the hold-current analyzer 126 sets the operating current of the current sink 118 at a value approximately 2%, 5%, or 10% greater than the minimum hold current to provide for a safety margin against noise, temperature changes, or other transient effects. In one embodiment, the hold-current analyzer 126 stores one or more predetermined hold currents in a nonvolatile memory and provides one of the predetermined hold currents to the constant-current sink 118 in lieu of analyzing either of the electronic transformer 106 or dimmer 110.

Figure 2:
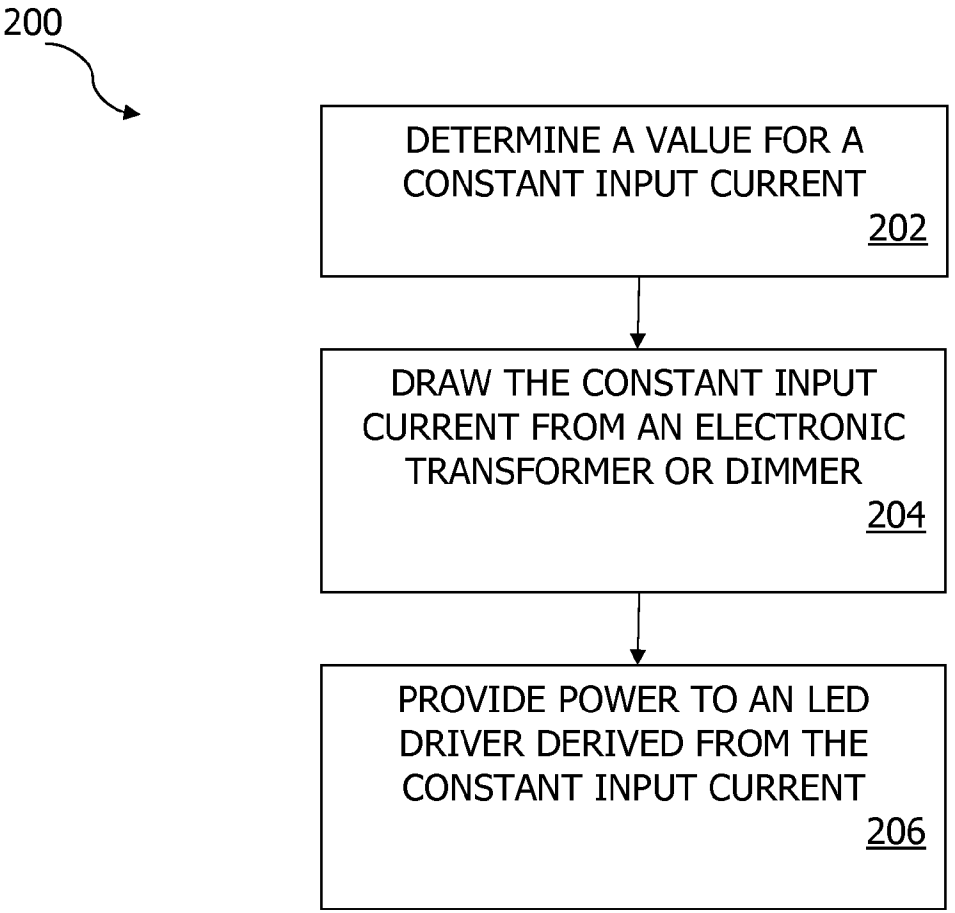
FIG. 2 is a flowchart illustrating a method for drawing a constant input current in accordance with an embodiment of the invention.

A method for reducing power consumed by an LED driver in accordance with an embodiment of the invention is illustrated by a flowchart 200 in FIG. 2. A value for a constant input current is determined (Step 202). In various embodiments, the value may be read from a predetermined, stored value or may be determined by analyzing the hold currents of an electronic transformer and/or a dimmer. (The determined value may thereupon be stored and thereafter read out and used during operation.) The constant input current is drawn from the electronic transformer and/or dimmer such that it is constant over a wide range of input voltages (Step 204). Using the received input current, power is provided to an LED driver (Step 206).

Certain embodiments of the present invention were described above. It is, however, expressly noted that the present invention is not limited to those embodiments, but rather the intention is that additions and modifications to what was expressly described herein are also included within the scope of the invention. Moreover, it is to be understood that the features of the various embodiments described herein were not mutually exclusive and can exist in various combinations and permutations, even if such combinations or permutations were not made express herein, without departing from the spirit and scope of the invention. In fact, variations, modifications, and other implementations of what was described herein will occur to those of ordinary skill in the art without departing from the spirit and the scope of the invention. As such, the invention is not to be defined only by the preceding illustrative description.

What is claimed is:

1. A method for reducing power consumed by an LED driver, the method comprising:

drawing, from an electronic transformer or dimmer, an input current that is substantially constant over a plurality of input voltages;

providing the input current to power the LED driver;

monitoring an output current of the LED driver; and lowering the constant input current when the output current exceeds a threshold.

2. The method of claim 1, wherein the constant input current is greater than or substantially equal to a minimum hold current of one of the dimmer or the electronic transformer.

3. The method of claim 1, wherein the constant input current is greater than or substantially equal to the greater of a minimum hold current of the dimmer or a minimum hold current of the electronic transformer.

4. The method of claim 1, wherein a value of the constant input current is previously determined.

5. The method of claim 1, further comprising determining a value of the constant input current.

6. The method of claim 5, wherein determining the value of the constant input current comprises adjusting the input current until a hold current of one of the electronic transformer or the dimmer is reached.

7. The method of claim 6, wherein the reaching of the hold current is determined by a collapse of an input power waveform.

8. A system for reducing power consumed by an LED driver, the system comprising:

a constant-current sink for drawing, from an electronic transformer or dimmer, an input current that is constant over a plurality of input voltages;

an output driver for receiving the constant input current and powering an LED therewith; and a current sensor for determining a level of an output current provided to the LED, wherein the constant-current sink reduces the constant input current if the current sensor detects the output current increasing past a threshold.

9. The system of claim 8, further comprising a hold-current analyzer for determining a hold current of one of the electronic transformer or dimmer, wherein the constant input current is greater than or substantially equal to the hold current.

10. The system of claim 9, wherein the hold-current analyzer comprises digital processing logic and a storage element.

11. The system of claim 9, wherein the hold-current analyzer comprises an input current controller for lowering the input current until a collapse of an input power waveform is detected.

12. The system of claim 8, further comprising a storage element for storing a predetermined value of the constant input current.

13. The system of claim 8, wherein the output driver reduces the output current if the current sensor detects the output current increasing past a threshold.

14. The system of claim 8, wherein the constant-current sink comprises a current source or a switched-capacitor circuit.

* * * * *